US005863411A

United States Patent [19]

Kang et al.

[11] Patent Number: 5,863,411

[45] **Date of Patent: *Jan. 26, 1999**

[54] METHOD FOR FORMING A MINUTE PATTERN IN A METAL WORKPIECE

[75] Inventors: Seung-oun Kang, Seoul; Sang-young Moon, Ansan; Doo-heun Baek, Yongin-gun; Won-chae Suh, Seoul, all of Rep. of Korea

[73] Assignee: Samsung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 618,619

[22] Filed: Mar. 2, 1996

[30] Foreign Application Priority Data

Sep. 13, 1995 [KR] Rep. of Korea ..... 1995 29830

[51] Int. Cl.[6] ..... B23H 3/00; B23H 9/14; C25F 3/02

[52] U.S. Cl. ..... 205/645; 205/667

[58] Field of Search ..... 205/645, 666, 205/667; 430/318

[56] References Cited

U.S. PATENT DOCUMENTS

| | | | |
|---|---|---|---|
| 4,045,312 | 8/1977 | Satoshi | 205/667 |
| 4,629,539 | 12/1986 | Imai | 205/667 |
| 4,755,257 | 7/1988 | Yamamoto et al. | 430/318 |
| 5,183,725 | 2/1993 | Nishino et al. | 430/318 |
| 5,286,355 | 2/1994 | Fainchtein et al. | 204/129.55 |

FOREIGN PATENT DOCUMENTS

| | | | |
|---|---|---|---|
| 2037190 | 2/1972 | Germany | 205/667 |
| 59-191315 | 10/1984 | Japan | 205/667 |
| 62-46530 | 2/1987 | Japan | 205/645 |
| 1-291429 | 11/1989 | Japan | 205/645 |

*Primary Examiner*—Roland Martin
*Attorney, Agent, or Firm*—Jones & Volentine, L.L.P.

[57] ABSTRACT

A method for forming a minute pattern in a metal workpiece, comprising the steps of forming a mask pattern on the metal workpiece and electro-chemically etching the metal workpiece. The workpiece is electro-chemically etched in a electrolyte bath following formation of the mask pattern.

5 Claims, 3 Drawing Sheets

METHOD FOR FORMING A MINUTE PATTERN IN A METAL WORKPIECE

BACKGROUND OF THE INVENTION

The present invention relates to a method for forming a pattern in a metal workpiece. More particularly, the present invention relates to a method for forming a minute pattern in a metal workpiece using a photolithography process and an electro-chemical etching process.

A laser process or a super-drill process is typically used to form a circular, minute pattern in a workpiece. In contrast, a non-circular, minute pattern is typically formed by an ion beam milling process. However, these conventional processes do not work well when applied to a metal workpiece.

The laser and super-drill processes suffer from similar problems which include: (a) the oxidation of the workpiece surface by heat generated during the process; (b) non-uniformity in circular patterns, and the resulting mismatch between circular openings formed on opposite sides of the workpiece; (c) the impossibility of forming non-circular, minute patterns; and, (d) the complexity and cost of the required equipment.

SUMMARY OF THE INVENTION

The present invention provides a method of forming a pattern in a metal workpiece which overcomes the foregoing problems. To achieve these results, the present invention provides a method of forming a minute pattern in a metal workpiece, comprising the steps of forming a mask pattern on the metal workpiece, and electro-chemically etching the metal workpiece.

The mask pattern is formed on the workpiece by forming a photoresist layer over the metal workpiece, forming a mask over the photoresist layer, patterning the photoresist layer to form the mask pattern, and developing the patterned photoresist layer.

The electro-chemical etching of the metal workpiece occurs in a electrolyte bath following formation of the mask pattern on the metal workpiece and connection of the workpiece to a voltage source electrode.

Preferably, the electro-chemical etching step is performed with an applied voltage of 6V DC and in an etchant consisting of a 1:2 ratio of KOH and $H_2O$.

BRIEF DESCRIPTION OF THE DRAWINGS

The above advantages of the present invention will become more apparent upon consideration of a preferred embodiment with reference to the attached drawings in which.

DETAILED DESCRIPTION OF THE INVENTION

Figure 1A:
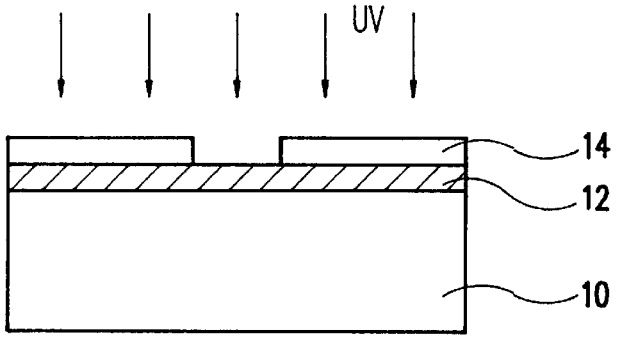
FIGS. 1A–1D illustrate a method of forming a pattern in a metal workpiece according to the present invention.

The method of forming a minute pattern in a metal workpiece according to the present invention will be described with reference to FIGS. 1A–1D. Here, reference numeral 10 denotes a metal workpiece, reference numeral 12 denotes a photoresist layer, and reference numeral 14 denotes a mask pattern which may be of any shape, including, for example, a circle, a star or an irregular polygon.

As seen in section view FIG. 1A, photoresist layer 12 is formed by spin-coating the metal workpiece with a photoresist solution. Mask pattern 14 is then applied over photoresist layer 12. Thereafter, workpiece 10 is exposed to ultraviolet (UV) rays for about ten minutes.

Figure 1B:
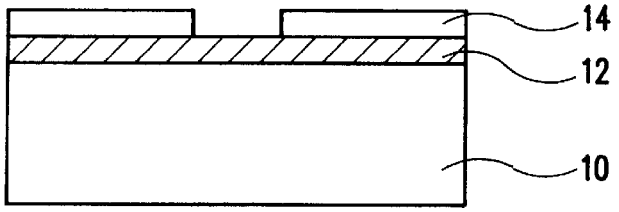

In section view FIG. 1B, after developing photoresist layer 12 using mask pattern 14, workpiece 10 is dried. After drying, workpiece 10 is examined with a microscope. If a defect is detected, the foregoing developing and drying steps may be repeated. If no defect is detected or after correction of the detected defects, an insulating material (not shown) may be deposited over the surfaces not to be etched after which the workpiece is again dried.

Figure 1C:
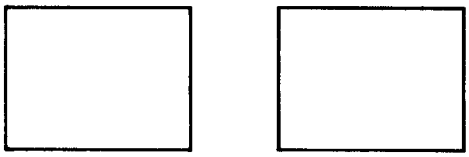

FIG. 1C is a section view of the completed workpiece following an electro-chemical etching step and a cleaning step.

Figure 2:
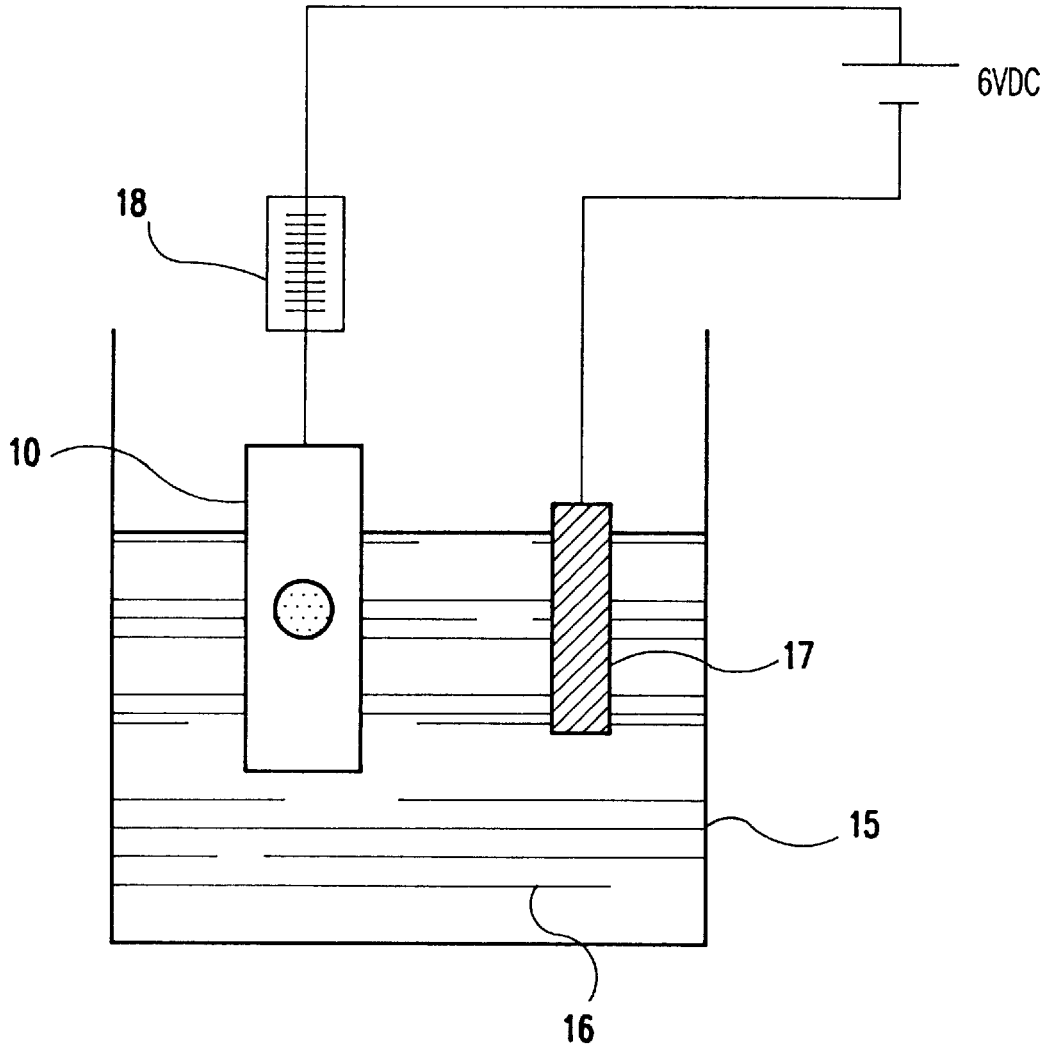
FIG. 2 is a diagram illustrating an electro-chemical etching process.

The electro-chemical etching step will be described with reference to FIG. 2 which shows a system used to accomplish this step. Referring to FIG. 2, workpiece 10 is connected to a micrometer 18 which in turn is connected to one electrode of a DC voltage source. The other electrode 17 of the DC voltage source is, along with workpiece 10, submerged in an electrolyte bath 15 containing an electrolyte 16. Electrolyte 16 is preferably an etchant having a 1:2 ratio of KOH and $H_2O$.

When the DC voltage, here 6 Volts, is applied across metal workpiece 10 and electrode 17, metal atoms from workpiece 10 are ionized according to the pattern and transferred to electrode 17. Within this step, etching time should be controlled according to the thickness, quality and type of the metal forming workpiece 10. For example, 50 $\mu$m of tungsten would be etched for about three minutes. Etching speed and the depth at which the workpiece is submerged in the electrolyte bath 15 are controlled by micrometer 18.

After the above electro-chemical etching process, workpiece 10 is put in an acetone solution for ultrasonic cleaning.

Figure 1D:
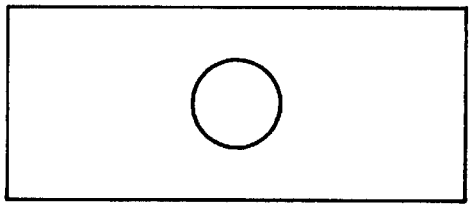

FIG. 1D is a plan view of the completed workpiece. Here, it is noted that a perfect circular pattern is formed without damage to the periphery.

Figure 3:
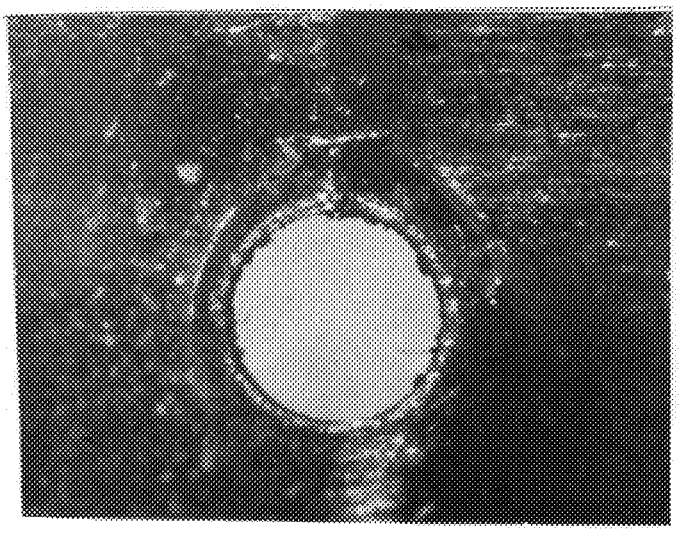
FIG.3 PRIOR ART
FIG. 3 is a photograph of a metal workpiece patterned by a conventional laser process.
Figure 4:
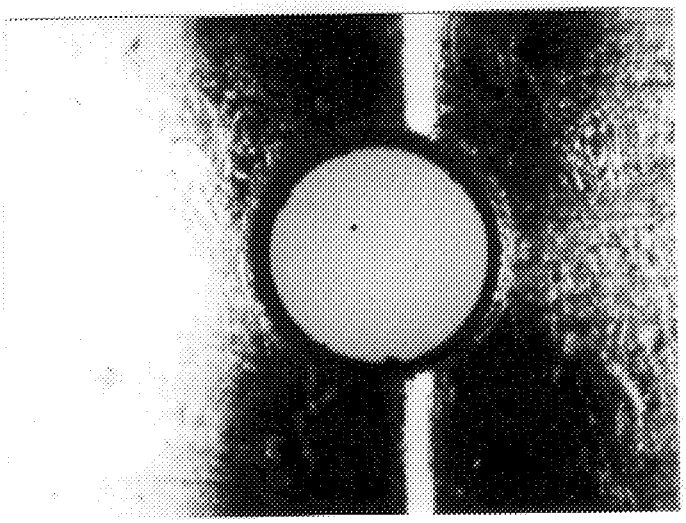
FIG.4 PRIOR ART
FIG. 4 is a photograph of a metal workpiece patterned by a conventional super-drill process.

FIGS. 3 and 4 are photographs of workpieces patterned by conventional methods. FIG. 3 shows a workpiece patterned by the conventional laser process. FIG. 4 shows a workpiece patterned by the conventional super-drill process. In both FIGS. 3 and 4, it can be seen that the periphery of the patterned circle has been damaged by heat resulting from the foregoing conventional processes.

Figure 5:
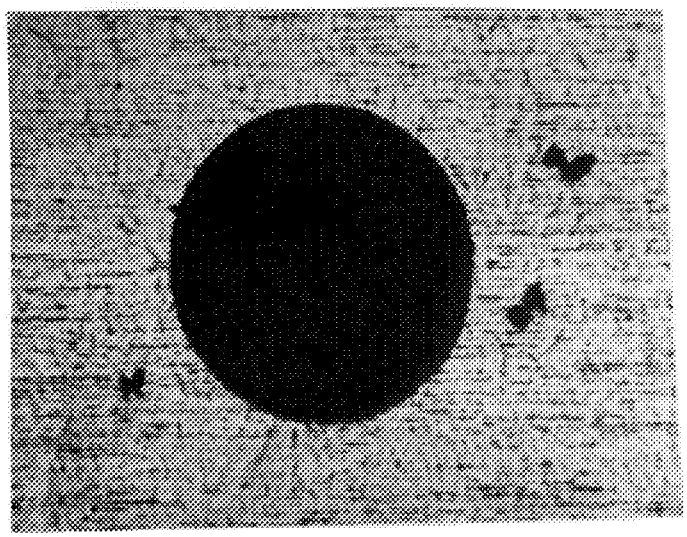
FIG. 5 is a photograph of a metal workpiece patterned according to the present invention.

In contrast, FIG. 5 is a photograph of a workpiece patterned according to the method of the present invention. Here, no periphery damage is evident.

The method of forming a minute pattern in the metal workpiece comprising a photolithography step and an electro-chemical etching step provides several benefits which include: (a) oxidation of the workpiece does not occur because the electro-chemical etching does not generate heat; (b) minute patterns having complex shape other than a circle can be easily manufactured; (c) the process is performed by readily available equipment, according to a simple principle, so that product cost can be reduced; and, (d) equal-sized openings may be formed on opposite sides of a workpiece.

The foregoing description of a presently preferred embodiment has been given by way of example. The present invention is not limited to the particular form illustrated and further modifications and improvements will occur to those skilled in the art within the spirit and scope of this invention as defined by the attached claims.

What is claimed is:

1. A method for forming a minute pattern in a metal workpiece, comprising the steps of:

providing an electrolyte bath;

forming a mask pattern on one face of a two-faced metal workpiece by, forming a photoresist layer over the metal workpiece;

forming a mask over the photoresist layer;

patterning the photoresist layer according to the mask by exposing the patterned photoresist layer to light; and developing the patterned photoresist layer;

connecting the metal workpiece having the patterned photoresist layer thereon to a first electrode of a voltage source electrode, wherein a second electrode of the voltage source electrode is submerged in the electrolyte bath; and, submerging the metal workpiece in the electrolyte bath while applying a voltage across the submerged metal workpiece and the second electrode, for a period of time sufficient to electro-chemically etch the metal workpiece until the pattern is etched through an entire thickness of the workpiece to form an equal-sized two-faced opening through the two-faced metal workpiece.

2. The method of claim 1, wherein said metal workpiece is tungsten steel having a thickness of 50 $\mu$m, and said etching step is performed for approximately three minutes.

3. The method of claim 2, further comprising a step of:

providing a micrometer between the voltage source electrode and the patterned metal workpiece.

4. The method of claim 1, further comprising steps of drying the metal workpiece after developing the patterned photoresist layer, and examining the metal workpiece under a microscope for defects in the patterned photoresist layer before performing the electro-chemical etching step.

5. The method of claim 4, whereupon detection of a defect in the patterned photoresist layer, the method further comprises the steps of:

removing the patterned photoresist layer having the defect; and forming a new mask pattern on the metal workpiece by forming a new photoresist layer over the metal workpiece, forming the mask over the new photoresist layer, patterning the new photoresist layer according to the mask by exposing the patterned photoresist layer to light, and developing the patterned photoresist layer before proceeding to the electro-chemical etching step.

* * * * *